United States Patent [19]

Thigpen et al.

[11] Patent Number: 4,837,838

[45] Date of Patent: Jun. 6, 1989

[54] ELECTROMAGNETIC TRANSDUCER OF IMPROVED EFFICIENCY

[75] Inventors: F. Bruce Thigpen; David E. Collie, both of Tallahassee, Fla.

[73] Assignee: Eminent Technology, Inc., Tallahassee, Fla.

[21] Appl. No.: 31,594

[22] Filed: Mar. 30, 1987

[51] Int. Cl.[4] ..... H04R 7/02; H04R 7/04

[52] U.S. Cl. ..... 381/158; 381/188; 381/192; 381/196; 381/199; 181/172; 181/173

[58] Field of Search ..... 381/153, 154, 155, 158, 381/163, 184, 187, 188, 192, 193, 196, 199, 201, 202; 181/166, 171, 172, 173

[56] References Cited

U.S. PATENT DOCUMENTS

| | | | |
|---|---|---|---|
| 1,815,564 | 7/1931 | High . | |
| 2,997,739 | 12/1976 | Kishikawa et al. . | |
| 3,674,946 | 7/1972 | Winey . | |
| 3,939,312 | 2/1976 | McKay | 381/196 |
| 4,156,801 | 5/1979 | Whelan et al. . | |
| 4,242,541 | 12/1980 | Ando . | |
| 4,273,968 | 6/1981 | Suyama . | |
| 4,337,379 | 6/1982 | Nakaya . | |
| 4,468,530 | 8/1984 | Torgeson | 381/196 |
| 4,471,172 | 9/1984 | Winey . | |
| 4,471,173 | 9/1984 | Winey | 381/199 |
| 4,480,155 | 10/1984 | Winey . | |
| 4,484,037 | 11/1984 | Nieuwendijk et al. . | |

OTHER PUBLICATIONS

Hi-Fi Answers, Haymarket publication, 12/84.
Hi-Fi Answers, (Apogee Duetta), 5/86.

*Primary Examiner*—Donald J. Yusko
*Assistant Examiner*—Tyrone Queen
*Attorney, Agent, or Firm*—Dowell & Dowell

[57] ABSTRACT

An electromagnetic transducer is disclosed wherein separate elongated strips of magnetic material are secured on both sides of a plane containing a flat flexible insulating thin-film diaphragm. Conductors attached to the diaphram extend primarily parallel to the magnetic strips and cause movement of the diaphram when excited electrically. The conductors can also deliver current induced by diaphram movement within the field. The magnetic strips are fastened to a frame that clamps the perimeter of the diaphram. The sub-assemblies containing the magnetic strips provide maximum available area for the propagation of acoustic waves to and from the environment and provide increased flux density.

23 Claims, 5 Drawing Sheets

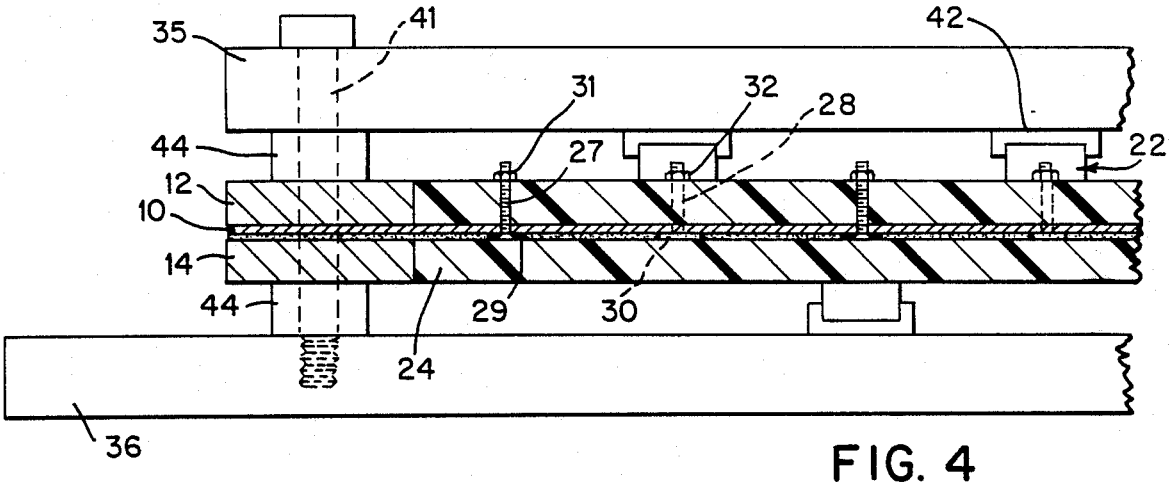
FIG. 4
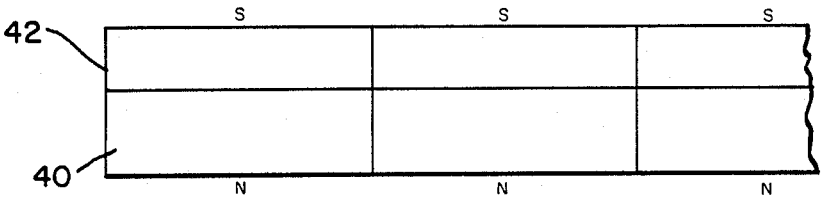
FIG. 5
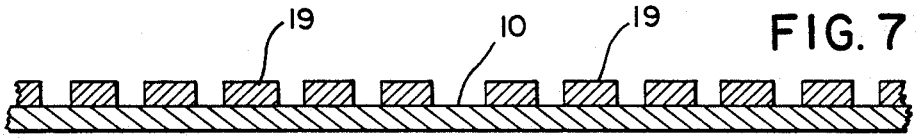
FIG. 7
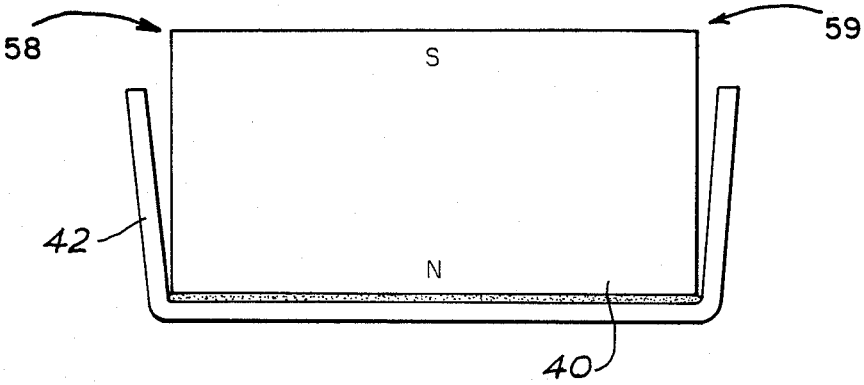

ELECTROMAGNETIC TRANSDUCER OF IMPROVED EFFICIENCY

BACKGROUND OF THE INVENTION

1. Field of the Invention.

The invention relates to a planar electromagnetic transducer that can be used in loudspeakers, headphones, microphones, or devices of a similar nature.

Planar magnetic loudspeakers have enjoyed distinct advantages over dynamic cone direct radiator type loudspeakers. They exhibit wider bandwidth and phase characteristics than typical cone units. Planar magnetics are at a disadvantage when compared to electrostatic type planar loudspeakers which exhibit better linearity. They are also at a disadvantage when compared to direct radiator cone loudspeakers with respect to efficiency.

The disadvantages of planar magnetics when compared to electrostatic type planar loudspeakers are the result of several factors. The electrostatic loudspeakers have the advantage of being able to drive a diaphragm uniformly over its entire area, which prevents a diaphragm breakup, as well as to drive it linearly by means of a constant charge operation.

An inherent problem with planar magnetic loudspeakers is driving the diaphragm uniformly across the entire area without becoming non-linear. See discussion in the patent to Torgeson, U.S. Pat. No. 4,468,530. The planar magnetic designs which have magnets on only one side of the diaphragm are inherently non-linear as indicated in the patent to Winey U.S. Pat. No. 3,674,946. The planar magnetic loudspeakers with like poles opposed on either side of the diaphragm are efficient, but have been demonstrated to have a linear magnetic field only within a narrow region between the magnets as indicated in the Torgeson patent. If conductors are placed across the entire area of the diaphragm, non-linearity results. The only known prior art type of planar magnetic loudspeaker that can be linear and have uniform drive area is one where the magnets are located on both sides of the diaphragm with alternate poles and with the magnets staggered so that flux lines run diagonally across the diaphragm. This approach in order to be linear must have conductors substantially covering the entire diaphragm as indicated in the patent to McKay U.S. Pat. No. 3,939,312. Because of the diagonal flux lines, the transfer efficiency is lower than that of other planar magnetics, electrostatics, and cone type loudspeakers.

2. Description of the Prior Art

The Patent to McKay U.S. Pat. No. 3,939,312 discloses a transducer having sheets of magnets in which the poles are alternately spaced so that the flux lines are disposed in a zig-zag fashion across the space between the two lines of magnets. Conductors are positioned in the space to intercept the magnetic flux that is present in the zones between the magnets. The plates which carry the magnets are pierced with a pattern of holes to permit passage of the sound vibrations from the diaphram on which the conductors are mounted.

The Patent to High U.S. Pat. No. 1,815,564 also discloses the use of magnetic poles alternately arranged providing a flux field between which the diaphram carrying conductors is positioned.

The Patent to Winey U.S. Pat. No. 3,674,946 discloses the use of a plurality of vibratable diaphrams formed to vibrate independently of each other and which are electrically isolated in an electromagnetic transducer having magnetic material located on one side of the diaphram.

Other Patents to Winey U.S. Pat. Nos. 4,471,172; 4,471,173; and 4,480,155 disclose elongated magnet strips carried on a sheet of magnetic material or connected by narrow bridges and mounted in pairs so that the flux field passes between adjacent magnets and through the conductors on a diaphram in a space between oppositely positioned magnets. Various arrangements of magnets and conductors are disclosed. The conductors may be formed in various ways, such as with round wire, foil, or metal film deposited on the film and etched away. A multiplicity of parallel conductors in a band is also disclosed.

The Patent to Whelan U.S. Pat. No. 4,156,801 discloses a diaphram having conductors thereon in a space between opposed pairs of magnets of like polarity and in which undriven areas of the diaphram are baffled to minimize the effects of vibrations.

The Patent to Torgeson U.S. Pat. No. 4,468,530 discloses a diaphram having conductors thereon in a space between opposed pairs of magnets of like polarity, the diaphram being divided into sections by means of rubber separator strips, and the arrangement of magnets within the various sections differing in order to provide zones of different frequency.

SUMMARY OF THE INVENTION

It is an object of the present invention to provide an improved electromagnetic transducer.

A further object is to provide an electromagnetic transducer having an improved permanent magnetic field structure, resulting, among other advantages, in an increase in its efficiency.

A further object is to provide an electromagnetic transducer in which the positioning of the conductors upon the diaphragm within the permanent magnetic fields results in an increase in its linearity.

It is a further object to provide an electromagnetic transducer in which, due to the arrangement of a plurality of conductors, the diaphram is driven uniformaly over its entire area and various parts of the diaphram can be controlled or driven separately.

A further object is to provide an electromagnetic transducer used as a loudspeaker in which, the arrangement of conductors permits low, mid-range, and high frequency drivers to co-exist on the same diaphram.

A still further object is to provide an electromagnetic transducer used as a loudspeaker in which the arrangement of conductors can be used to permit portions of a single diaphram to produce separate phase differentiated and or time delayed signals to enhance the sound stage imaging of a stereo signal.

To accomplish these objectives, the present invention includes separate elongated strips of permanently magnetic material alternately spaced and secured on both sides of a plane containing a flat flexible insulating thin-film diaphram. The use of separate strips of magnetic material makes it possible to control the amount of open area available for the coupling of the acoustic wave. The shape and magnetic permeability of the magnetic strip directs the flux towards the diaphragm and yields an increase in efficiency and band width over previous transducers of this type. The strips need not be the same distance from the diaphram nor from each other. It is important that they do not hinder the movement of the diaphram and that they allow a sufficient space for acoustic wave communiation.

Attached to the diaphram are conductors shaped into thin oblong coils. The conductors are arranged so that a large percentage of the total conductor length is parallel to the elongated magnetic strips and therefore within a static magnetic flux field and so that the diaphragm is substantially covered, as shown.

A group of conductors may be within a static flux field from a group of two or three magnetic strips. Further, any given magnetic strip may be used in association with more than one conductor group.

Any conductor group or element within a flux field created by the magnetic strips can be used to independently drive the portion of the diaphram that it covers. Time and frequency altered signals from different parts of the spectrum can be direct to selected areas of the diaphram thereby permitting distinct drivers to co-exist on the same diaphram. Further, a small amount of an inverted signal from a cooperating stereo or quadraphonic channel transmitted by some of the conductor groups in a loudpeaker of this design, would serve to attenuate, for a given listening ear, the effects of interaural crosstalk from the main driver of the cooperating loudspeaker, thereby aiding perception of localization in the reproduced sound stage.

BRIEF DESCRIPTION OF THE DRAWINGS

FIG. 4 is a section taken along the line 4—4 of FIG. 1, illustrating the conductor element terminal nodes.

FIG. 5 is a fragmentary side elevation of a magnetic material strip, to an enlarged scale.

FIG. 7 is a fragmentary end view, to an enlarged scale, illustrating a preferred form of magnetic strip and the associated conductors on a diaphram.

DESCRIPTION OF THE PREFERRED EMBODIMENTS

Figure 1:
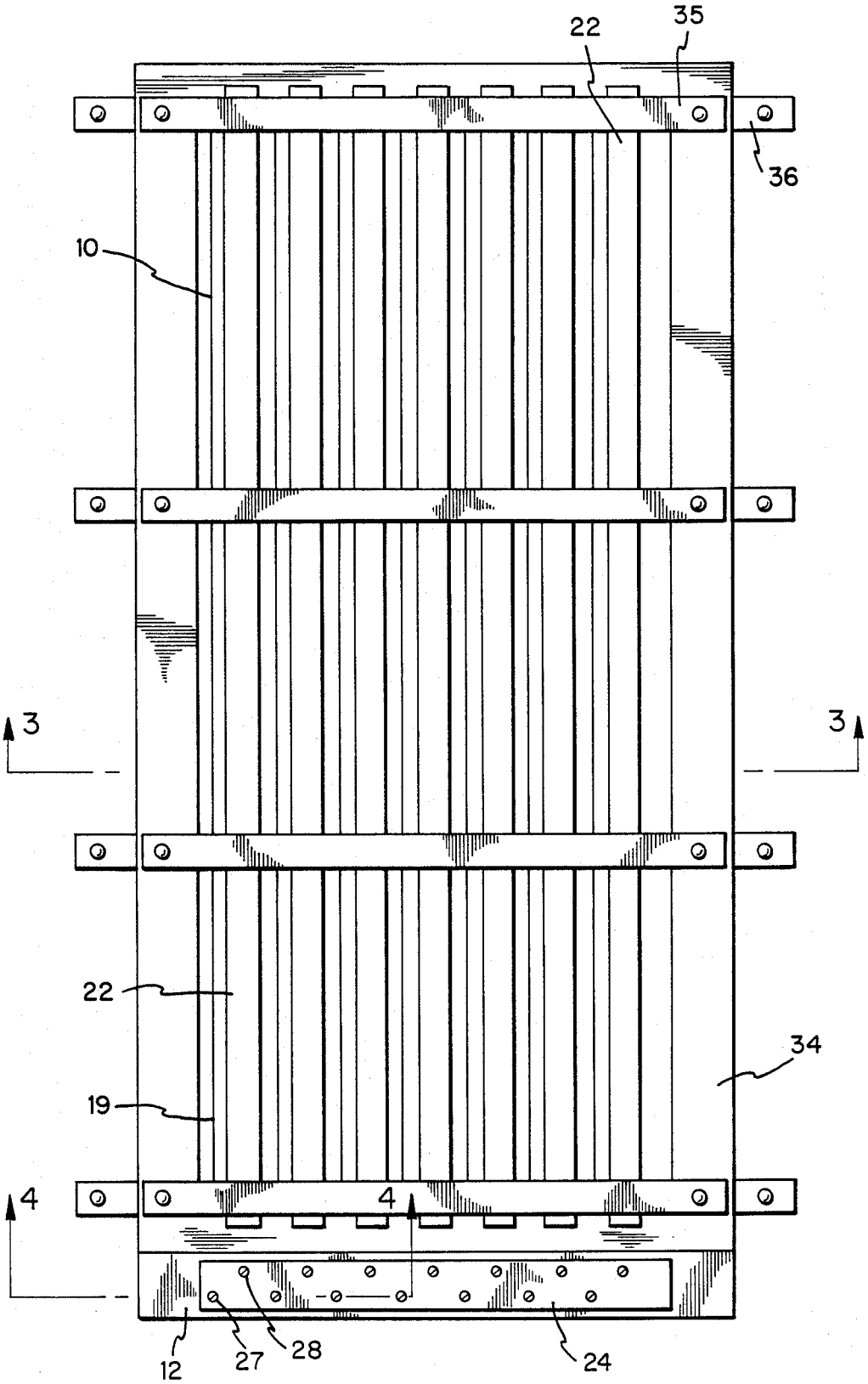
FIG. 1 is a plan view of one embodiment of the present invention, omitting details of the conductors.

With reference to the drawings, a planar electromagnetic transducer in the form of a unit loudspeaker is illustrated. It has a flat flexible insulating thin-film diaphragm 10 in a rectangular shape with upper side and end frame members 11, 12 and lower side and end members 13 and 14 holding the perimeter edges. Attached to the diaphragm are conductors 19 which may be arranged in elements 20 in various configurations, thin oblong coil patterns, as shown, being preferred. Unitary elongated permanent magnetic strips 22 alternately spaced and secured to both sides of the diaphragm, conductors, and frame.

The diaphragm may comprise any suitable material that is rugged, yet flexible, has shape memory, and is electrically insulating. These characteristics may be found in many different kinds of thin-films such as a polyester, Mylar made by E. I. Du Pont de Nemours & Co. Inc., Circleville, Ohio. A thin layer of adhesive material is used to attach the diaphragm 10 to the frame. A suitable adhesive is the Joining Systems with Isotac P.S. available in a roll of 5 mil thick tape from the 3M Co., St. Paul, Minn. 55101. The tensioning of the diaphragm prior to adhering it to the frame may be done in any desired manner well known in the art.

The frame members are preferably of a rigid material such as aluminum of sufficient strength to hold the diaphragm under tension and may be anodized to provide good cosmetic appearance and electrical insulation from the conductors 19. Frame end members 12, 14 are extended to provide a pocket or space 23 to receive an insulating terminal board 24 that is connected thereto by suitable means such as adhesive. Screws 27 and 28 (see FIG. 4) are connected to pads 29, 30 at each end of the elements and extend through the terminal board for retention by nuts 31, 32, providing terminals for the elements.

Conductor elements 20 (see FIG. 2) can be produced by etching the desired configuration on a thin sheet of aluminum foil that has been laminated to the Mylar. The foil/polyester laminate is available from Lamotite, Inc. of Cleveland, Ohio. The first step in the etching process is to "freeze" the laminate to glass or another smooth flat material. This is done by using a squeegee to spread a thin layer of water between the laminate and the flat material. The result is a smooth working surface of foil upon which a design can be silk screened. After the ink dries the material is etched in a Ferric Chloride solution. The ink is then removed and only the elements remain adhered to the diaphragm substrate.

Figure 2:
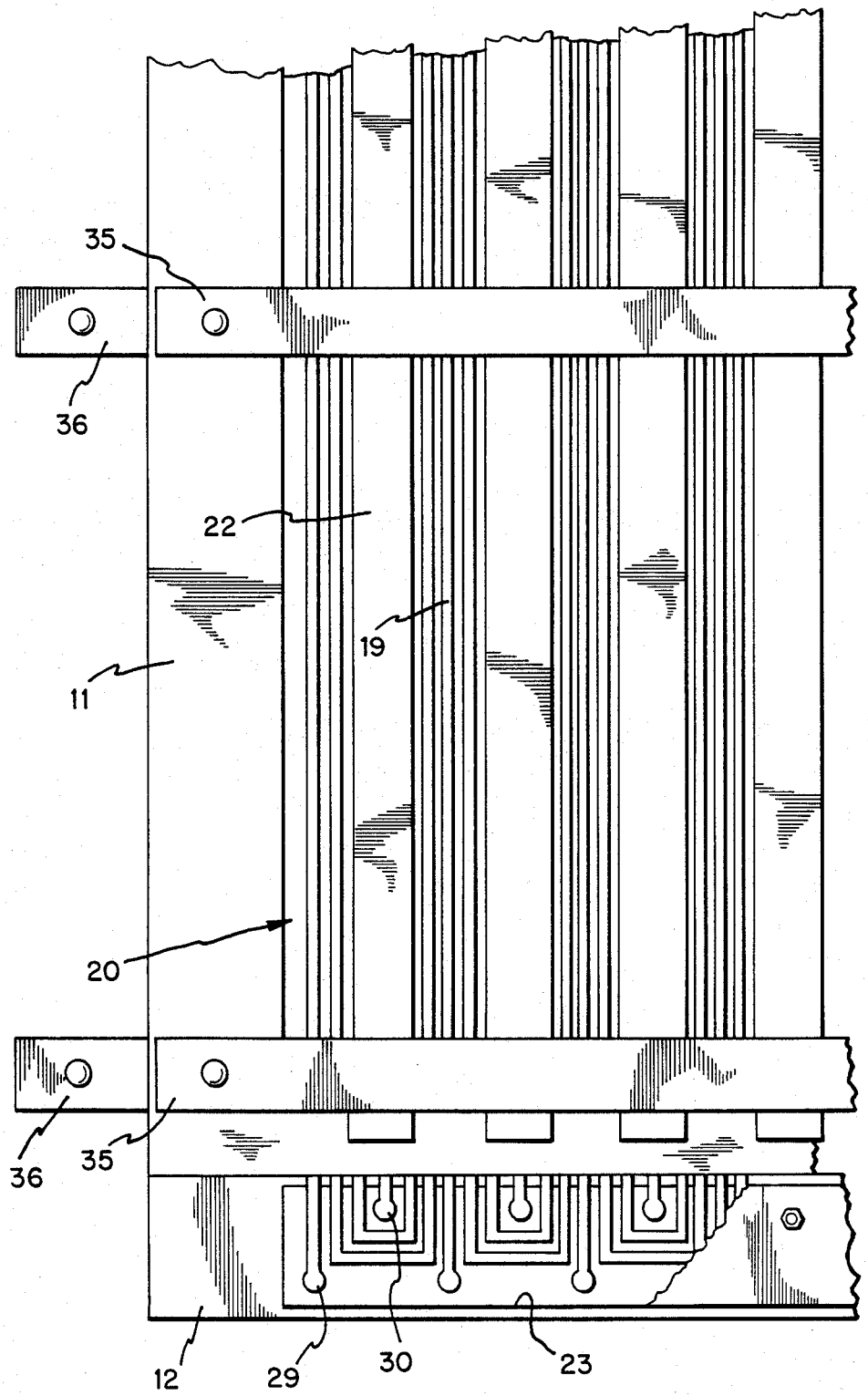
FIG. 2 is a plan view to an enlarged scale of a corner portion of the invention shown in FIG. 1, and illustrating one possible configuration of conductors on the diaphragm.
Figure 3:
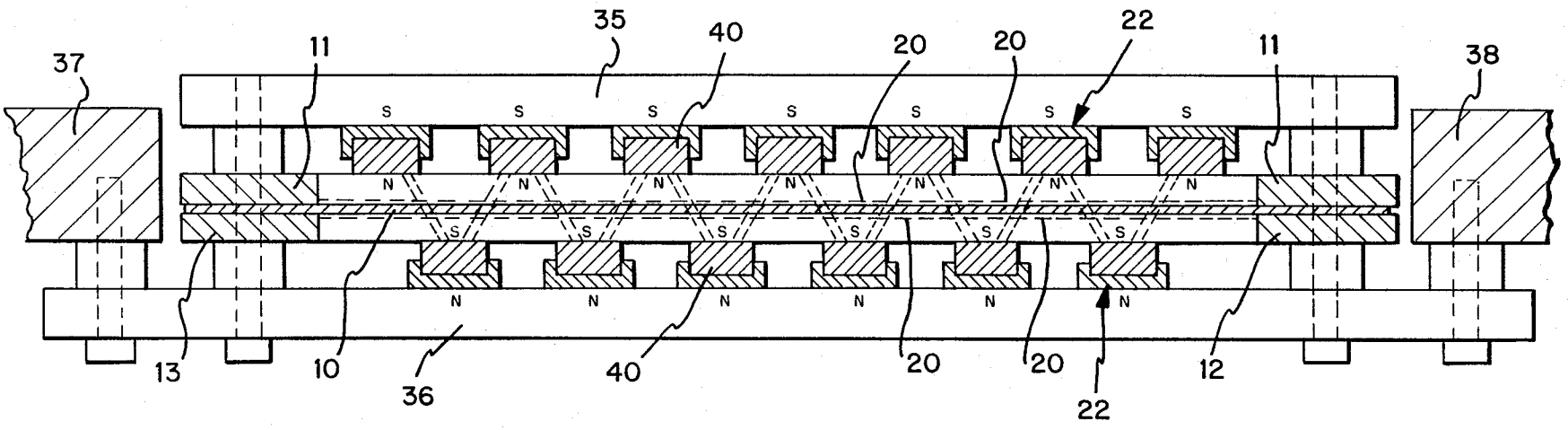
FIG. 3 is a section taken along the line 3—3 of FIG. 1, illustrating a preferred magnetic strip arrangement.

FIG. 2 is a detail of a corner portion of the plan view of FIG. 1, the insulating terminal board 24 being partially broken away. Conductor elements with 3 turns are illustrated, although other arrangements may be used. FIG. 3 shows a diaphragm 10 with conductor elements 20 mounted on both sides of the diaphrapm, although in certain situations one side attachment may be preferred. Such mounting on both sides provides flexibility in selecting the total impedance of the transducer by the series or parallel wiring of the elements.

The assembly includes the magnetic strips 22 that are alternately spaced across the diaphragm 30 and secured by spaced upper and lower cross bars 35 and 36. Bars 36 are extended and may support baffles 37 and 38 beyond the sides of the unit loudspeaker to prevent attenuation of low frequencies. The baffles may be made of wood or other suitable sound damping material. The width of the loudspeaker may be increased or decreased by adding or removing magnetic strips and elements on either side.

The elongated strips 22 of magnetic material may be formed by short rectangular ceramic magnets 40 laid end-to-end in an elongated U-shaped channel 42 (see FIG. 5). A suitable magnet is the Genox 5 available from General Magnetic Co., Dallas, Tex. 75211. The channels are fastened by suitable means, such as welding, to the upper and lower cross-bars 35 and 36 in proper position with respect to each other and to the diaphram. The cross-bars are connected by fastening means 41 extending through the frame members and spacers 44.

The magnet channels or strips 42 provide increased efficiency necessary for wide band operation. In a planar magnetic loudspeaker, magnetic field strenght over the area of the diaphragm is required. Therefore, a large surface area of magnetic material is necessary.

Figure 6:
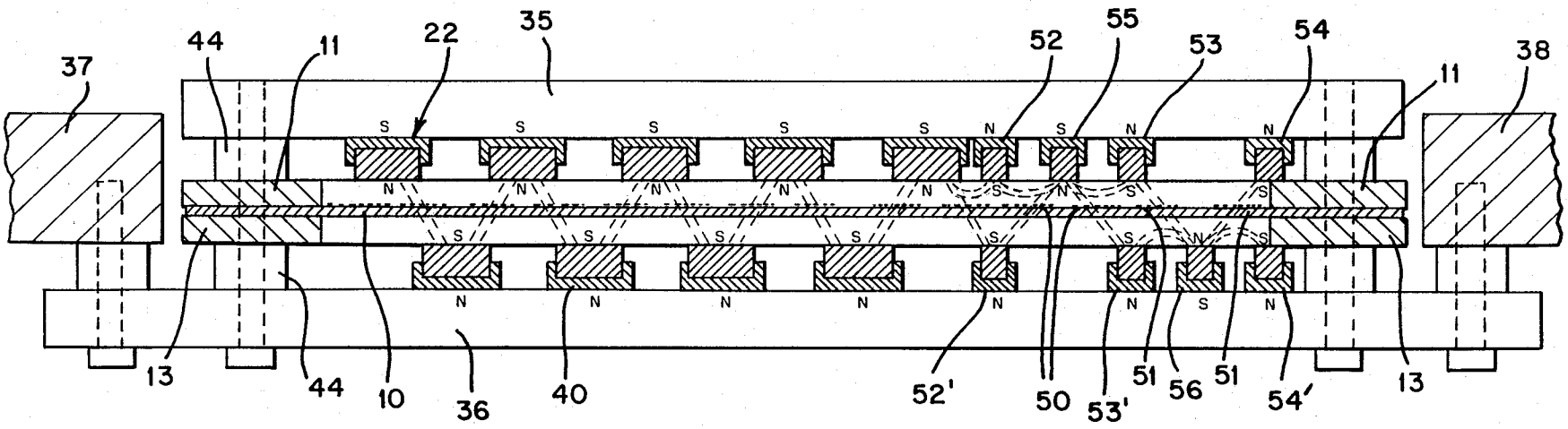
FIG. 6 is a section taken similarly to FIG. 3 illustrating an alternative magnetic strip and conductor arrangement.

In some prior magnetic transducers, such as Torgeson U.S. Pat. No. 4,468,530, the lines of magnetic flux run at right angles to the conductors on the diaphragm. Thus, the conversion efficiency (electrical input to acoustical power output) is good. In the present system, the lines of flux pass through the conductors 19 at an angle (see FIG. 3) dependent upon the magnetic spacing. The driving force decreases by the cosine of that angle which results in lower conversion efficiency. FIG. 6 indicates the use of a combination of alternative strip arrangement patterns. One pattern is seen on the left side of FIG. 6, and is similar to that of FIG. 3. The other pattern on the right side of FIG. 6, is used to drive two of the elements on one side of the transducer. The two elements on the right side are used in high frequency reproduction.

When the transducer is used as a loudspeaker it is desirable to reduce the higher frequency portions to a narrow strip to increase the sound dispersion characteristics at those frequencies. Since the mass of the diaphragm and air mass begin to have a greater effect on the output of a speaker at very high frequencies, more magnetic force is required to maintain constant output. The altered pattern includes three sets of relatively narrow magnetic strips 52, 52', 53, 53', and 54, 54' facing each other with like poles across the diaphram. The three sets are separated by two magnetic strips 55, 56 that are on opposite sides of the diaphram with no magnetic strip directly opposite them. The magnetic poles of the strips 55, 56 are opposite to that of the corresponding poles on the three sets of magnetic strips. This arrangement provides efficient driving of the high frequency portion of the diaphram. In addition, the structural support of the channels carrying the strips may be aided by the magnetic repulsion of the opposing sets of magnetic strips.

FIG. 7 illustrates a sound and vibration damper 60 in the form of a silicone glue or other suitable material in a thin layer between the magnetic material and the U-shaped channel. This prevents buzzing noises caused by the vibration of the magnetic material.

We claim:

1. An electromagnetic transducer, comprising support means, a flexible diaphragm having its perimeter mounted on said support means, elongated electrical conductor means mounted on said diaphragm, said conductor means having electrical connection means, a plurality of spaced first and a plurality of spaced second elongated permanent magnet means mounted on said support means parallel to but offset from each other and on opposite sides of said diaphragm, each first and second permanent magnet means having one pole on a side thereof which is contiguous to said diaphragm and an opposite pole on its remote side, each first and second permanent magnet means having poles of opposite polarity contiguous to said diaphragm, and said conductor means extending parallel to each first and second permanent magnet means and in the magnet flux field therebetween, in which each first and second permanent magnet means comprises a magnetic strip arranged in an elongated U-shaped channel of ferrous material, said channel having a web, the web of the channel being mounted on said support means, thereby causing an increase in flux field denstity at the pole which is contiguous to the diaphragm.

2. The invention of claim 1, said diaphragm having at least two electrical conductor means mounted on one side of said diaphram.

3. The inventin of claim 1, in which said electrical conductor means is formed of laminated or vapor deposited metal that is etched to produce the conductor means.

4. The invention of claim 1, in which said electrical conductor means is formed of a conductive ink coating.

5. The invention of claim 1, in which said electrical conductor means is formed of a light gauge wire.

6. The invention of claim 1, and acoustic baffles extending in the same plane and beyond the perimeter of said diaphragm and proximate to said perimeter.

7. The invention of claim 1, in which said electrical conductor means includes a plurality of conductors in spaced relationship on said diaphragm, said electrical connection means providing separate connections to each conductor, whereby different electrical signals may be provided to distinct areas of said diaphragm.

8. The invention of claim 1, in which said diaphragm is formed of a material such as a polyester, vinyl chloride, polypropylene, polyethylene, polymer or copolymer thin film, or a co-extrusion thereof.

9. The invention of claim 1, in which said magnetic strips are formed of short individual magnets arranged end-to-end.

10. The invention of claim 1, in which a sound and vibration dampening means is provided betwen the flexible diaphragm and the support means.

11. The invention of claim 10, in which the dampening means is an adhesive forming a permanent bond in a thin layer on both sides of said diaphragm and attaching it to said support means.

12. The invention of claim 1, in which said magnetic strip which are on the same side of the diaphragm are equally spaced.

13. The invention of claim 1, in which a first group of magnetic strips on the same side of the diaphragm are equally spaced apart a first dimension, and a second group is equally spaced apart a second, different dimension.

14. The invention of claim 1, in which a first group of magnetic strips on the same side of the diaphragm are of the same width and thickness, and a second group is of a different width and/or thickness.

15. The invention of claim 1, in which said conductor means is a relatively narrow oblong coil of thin, closely spaced conductors, whereby a high percentage of the conductors are within the magnetic field created by the magnetic means, thereby increasing transducer efficiency.

16. The invention of claim 9, in which a sound and vibration dampening means is provided between the short individual magnets and the channel.

17. The invention of claim 9, in which sound and vibration dampening means is provided between the interfaces of the short individual magnets.

18. An electromagnetic transducer, comprising support means, a flexible diaphragm having its perimeter mounted on said support means, elongated electrical conductor means having electrical connection means, a first group of a plurality of spaced first and a plurality of spaced second elongated permanent magnet means mounted on said support means parallel to but offset from each other and on opposite sides of said diaphragm, said permanent magnet means having one pole on a side thereof which is contiguous to said diaphragm and an opposite pole on its remote side, said first and second magnet means having poles of opposite polarity contiguous to said diaphragm, a second group of a plurality of spaced first and a plurality of spaced second elongated permanent magnet means mounted on said support means directly opposite each other across said diaphragm, said magnet means having poles of like polarity contiguous to said diaphragm, said first and second magnet means of said second group being spaced laterally, and an intermediate magnet means positioned in alternate ones of said space and offset from the intermediate magnet means on opposite sides of the diaphragm, said intermediate magnet means having a pole of opposite polarity to that of said first and second magnet means contiguous to said diaphragm, and said conductor means extending parallel to said groups of magnet means and in the magnetic flux field therebetween, in which each of said magnet means comprises a magnetic strip arranged in an elongated U-shaped channel of ferrous material, thereby causing an increase in flux density at the pole which is contiguous to the diaphragm.

19. An electromagnetic transducer, comprising support means, a flexible diaphragm having its perimeter mounted on said support means, elongated electrical conductor means having electrical connection means, a group of a plurality of spaced first and a plurality of spaced second elongated permanent magnet means mounted on said support means directly opposite each other across said diaphragm, said magnet means having poles of like polarity contiguous to said diaphragm, said first and second magnet means being spaced laterally, and an intermediate magnet means positioned in alternate ones of said space and offset from the intermediate magnet means and on opposite sides of the diaphragm, said intermediate magnet having a pole of opposite polarity to that of said first and second magnet means contiguous to said diaphragm, and said conductor means extending parallel to said group of magnet means and in the flux field therebetween, in which each of said magnet means comprises a magnetic strip arranged in an elongated U-shaped channel of ferrous material, thereby causing an increase in flux density at the pole which is contiguous to the diaphragm.

20. The invention of claim 19, in which the magnet means comprise one or more magnets arranged in an elongated U-shaped channel of ferrous material, the web of the channel being mounted on said support means, thereby causing an increase in flux field density at the pole which is contiguous to the diaphragm.

21. An electromagnetic transducer, comprising, support means, a flexible diaphragm having its perimeter mounted on said support means, elongated electrical conductor means mounted on said diaphragm, said conductor means having electrical connection means, and elongated permanent magnet means mounted on said support means parallel to and contoguous to said diaphragm, in which the permanent magnet means comprises one or more magnets arranged in an elongated U-shaped channel of ferrous material, said channel having a web, the web of the channel being mounted on said support means, thereby causing an increase in flux density at the pole which is contiguous to the diaphragm.

22. An electromagnetic transducer, comprising support means, a flexible diaphragm having its perimeter mounted on said support means, elongated electrical conductor means mounted on said diaphragm, said conductor means having electrical connection means, a plurality of spaced first and a plurality of spaced second elongated permanent magnet means mounted on said support means parallel to but offset from each other and on opposite sides of said diaphragm, said permanent magnet means having one pole on a side thereof which is contiguous to said diaphragm and an opposite pole on its remote side, said first and second magnet means having poles of opposite polarity contiguous to said diaphragm, and said conductor means extending parallel to said magnet means and in the magnetic flux field therebetween, in which said magnet means comprises magnetic strips and in which a first group of magnetic strips on the same side of the diaphragm are equally spaced apart by a first dimension, and a second group is equally spaced apart by a second, different dimension, in which each of said magnet means comprises a magnetic strip arranged in an elongated U-shaped channel of ferrous material, thereby causing an increase in flux density at the pole which is contiguous to the diaphragm.

23. The invention of claim 22, in which the first group of magnetic strips on the same side of the diaphragm are of the same width and thickness, and the second group is of a different width and/or thickness.

* * * * *